United States Patent [19]

Heinzle

[11] 4,437,640

[45] Mar. 20, 1984

[54] BRACING UNIT FOR CONCRETE FORMWORK

[75] Inventor: Otto Heinzle, Götzis, Austria

[73] Assignee: Schalungsverleih Heinzle AG Altstätten CH-9450, Switzerland

[21] Appl. No.: 322,087

[22] Filed: Nov. 17, 1981

[30] Foreign Application Priority Data

Nov. 25, 1980 [AT] Austria ..... 5759/80

[51] Int. Cl.[3] ..... B29H 5/02

[52] U.S. Cl. ..... 249/20; 249/65; 249/154; 249/160

[58] Field of Search ..... 249/20, 65, 154, 160

[56] References Cited

U.S. PATENT DOCUMENTS

| | | | |
|---|---|---|---|
| 3,451,108 | 6/1969 | Andersson | 425/63 |
| 3,472,477 | 10/1969 | Juhl | 249/20 |
| 3,583,666 | 12/1967 | Horstketter | 249/20 |
| 3,632,079 | 1/1972 | Rohlf | 425/63 |
| 4,060,358 | 11/1977 | Fougea | 249/20 |
| 4,290,576 | 9/1981 | Schworer | 249/20 |
| 4,352,647 | 10/1982 | Rocco | 249/65 |

*Primary Examiner*—John A. Parrish

*Attorney, Agent, or Firm*—Toren, McGeady and Stanger

[57] ABSTRACT

A bracing unit to secure a formwork panel to falsework or to a previously poured concrete structure includes a pressurized fluid inflatable and expandable hose and a rigid abutment member for supporting the hose and holding it against the outside surface of the formwork panel.

6 Claims, 4 Drawing Figures

BRACING UNIT FOR CONCRETE FORMWORK

SUMMARY OF THE INVENTION

The present invention is directed to a bracing unit for securing formwork to falsework supporting the formwork or to a previously poured section of a concrete structure. In the erection of concrete structures, particularly concrete walls, the formwork panels or sections must be pressed against a falsework structure for the formwork or, when the concrete structure is being constructed in stages or lifts, against the previously poured sections of the structure. Usually this is accomplished, especially in round structures, by driving a chucking or tightening wedge into the formwork structure so that the formwork panels are prestressed in the horizontal direction and are pressed against the falsework or previously poured concrete section.

Particularly in the construction of circular or arcuate structures, difficulties often arise because the friction between the formwork panels or sections and the existing or previously poured concrete sections is such that satisfactory bracing is almost impossible. Such difficulties are especially notable when the formwork is made of wood.

Therefore, the present invention is directed to a bracing unit for formwork panels or sections so that the disadvantages experienced in the past can be overcome and a satisfactory bracing of the formwork is assured.

In accordance with the present invention, a bracing unit is provided including a pressurized fluid expandable hose which can be positioned between the outside surface of the formwork and a rigid abutment member located on the outside surface.

After the formwork panels and the bracing unit are set up, it is only necessary to expand the hose by supplying a pressurized fluid, that is, by pneumatically or hydraulically expanding the hose, to guarantee that a uniform contact pressure is provided along the length of the formwork. As a result, it is not necessary for the individual formwork panels to slide along the falsework or on the previously poured concrete section, since an appropriate pressure is exercised over the entire length of the erected formwork with the pressure acting perpendicularly to the formwork. Not only is a satisfactory contact pressure applied to the formwork, but, in addition, the setup of the formwork is significantly facilitated. The relatively cumbersome job of driving in the tightening wedges can be replaced by simply switching on a pump which supplies the necessary pressure in the hose.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
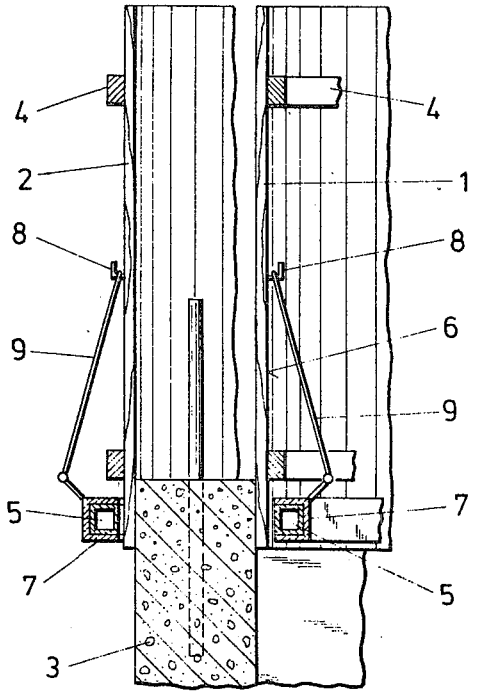
FIG. 1 is a vertical cross-sectional view through formwork secured to a previously poured concrete section.

As is known, formwork sections 1 and 2 can be constructed as formwork panels or individual boards and must be pressed against a corresponding falsework for supporting the formwork, not shown, with the formwork sections 1, 2 in spaced relation to receive the concrete pour. Alternatively, as shown in FIG. 1, the lower ends of the formwork sections 1 and 2 can be pressed against a previously poured concrete section. The lower ends of the two formwork sections 1, 2 must be pressed against the previously poured concrete section 3 so that the next lift or stage can be completed. The present invention can be utilized with a wide variety of formwork systems, where a number of formwork sections 1, 2 are held together by longitudinally extending supports 4.

Figure 2:
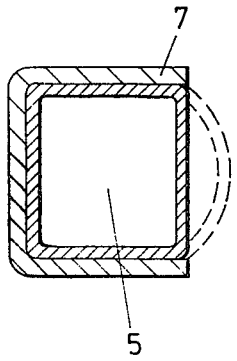
FIG. 2 is an enlarged detail view of a portion of the formwork support illustrated in FIG. 1.
Figure 3:
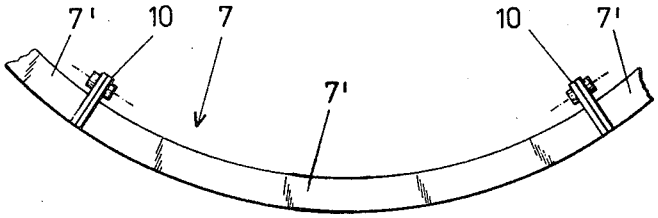
FIG. 3 is a partial plan view of a bracing unit for the formwork shown in FIG. 1.
Figure 4:
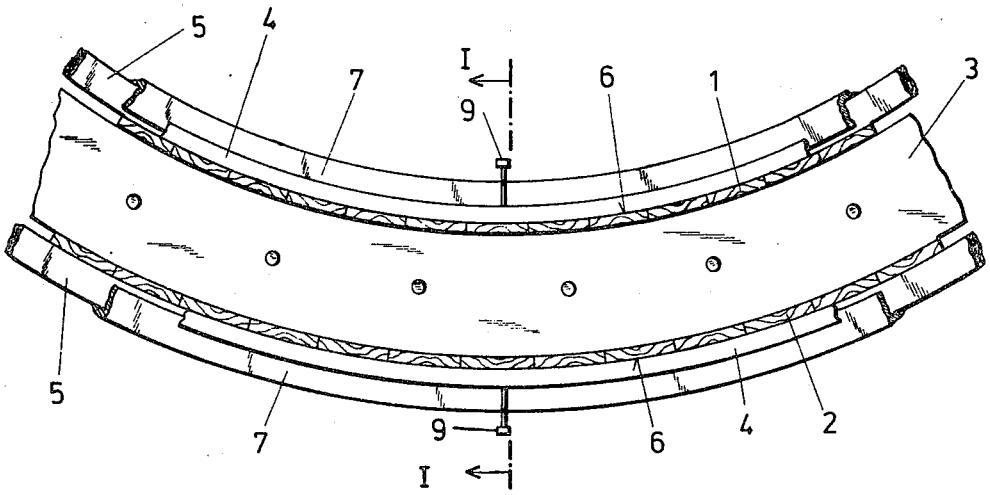
FIG. 4 is a partial plan view of the formwork shown in FIG. 1 with the formwork secured to a previously poured concrete section.

In accordance with the present invention, a pressurized fluid expandable hose 5 is secured against the outside surface 6 of the lower ends of the formwork sections 1, 2. The hose 5 is held against the outer surface 6 within a shaped rail 7 which affords a firm abutment. As shown, the shaped rail 7 has a rectangular cross-section and is open on the side facing the outside surface 6 of the formwork parts 1, 2. The shaped rail 7 is constructed so that it is resistant to bending to as great a degree as is possible for absorbing a corresponding pressure acting perpendicularly relative to the formwork sections 1,2. The preferred shape of the rail 7 is a U-shaped cross-section as shown in FIG. 2. Advantageously, hose 5 inserted into the shaped rail 7 has a rectangular cross-section so that, when the pressurized fluid medium is introduced into the hose, the hose expands outwardly from the open side of the rail into contact with the outside surface of the form section. It would also be possible to use a hose having a circular cross-section, however, a greater pressurization would be needed to achieve the contact pressure with the outside surface 6 of the formwork sections, because it is necessary for the hose to completely fill the interior of the shaped rail 7. While FIG. 2 shows a preferred cross-sectional shape of the rail 7 it would be possible to use other shapes, such as a member with a C-shaped cross-section.

The bracing unit embodying the present invention is particularly suitable for use in constructing concrete structures which have an arcuate shape, and especially a circular shape. With such a configuration of the formwork, the shaped rail 7 can be placed to extend close to the outside surface 6 of the formwork sections 1, 2 so that the rail 7 is closed in the circumferential direction and need only be suspended or hung from the formwork sections. Accordingly, hooks 8 are secured to the formwork sections 1, 2 above the lower ends with connecting rods 9 secured on the hooks and suspending the shaped rails 7. In such a formwork arrangement, struts extending inwardly toward the center of the shaped rail 7 are unnecessary, because the inner rail is merely under compression stress. This is true because the same stress acts over the entire circumference of the rail 7. As a result, no bending forces are developed. This arrangement according to the present invention is especially useful in round structures without any additional expenditure for special supporting means. If the shaped rails 7 illustrated in the drawing are used in constructing a round concrete structure the radially outer rail is under tensile stress and, as a result, it requires no additional supports or struts.

To disassemble the shaped rail for transportation, it can be made up of individual rail sections 7' connected together by means of flanges 10 located at the ends of the rail sections.

After the formwork sections 1 and 2 are set in place for pouring a concrete section, it is only necessary to connect the hose 5 to an appropriate pump so that the pressurized fluid medium can be charged into the hose. The pressurized fluid for expanding the hose can be compressed air or another suitable fluid. Since the hose is enclosed by the rail 7 and the outside surface of the form, it cannot be damaged by rough handling at a construction site, since the hose is protected when the formwork is moved to the next section to be poured.

It is also possible to set up the first part of the formwork to be poured without using falsework. This can be done by placing the formwork in the shape of the structure to be poured and then pouring the concrete into the formwork. Depending on the pressure head of the concrete inside the formwork, the counter-pressure provided by the bracing unit, that is, the pressure within the hose 5, is selected so that the position of the formwork sections cannot change.

When the bracing unit of the present invention is used in the construction of flat or planar walls, then the support for the hose constructed in the form of a shaped rail must be provided with appropriate reinforcement so that a uniform contact pressure is assured. Moreover, a firm support for the bracing unit must be provided. The bracing unit can be supported from an opposite wall or the abutment members contacting the inner and outer formwork surfaces can be interconnected by hinged tiebars. Where the formwork is associated with sections already poured, an interconnection of the rails can be effected by anchors inserted into the poured concrete section permitting an adequate buildup of pressure in the hose between the abutment and the formwork.

The arrangement of the present invention as disclosed above, is, however, most advantageously used in round or circular structures, such as silos, round stalls, liquid manure pits, septic tanks, and the like.

It is also possible to construct the rigid abutment member in a form other than a shaped rail. In one embodiment, a receiving groove for the hose 5 can be formed in a working platform moved along with the formwork. Such an arrangement can be utilized with the first formwork section for a concrete structure as well as for attachment to previously completed concrete sections. In the transition between two structural sections, a perfect contact pressure is secured using the present invention so that a smooth transition is afforded.

While specific embodiments of the invention have been shown and described in detail to illustrate the application of the inventive principles, it will be understood that the invention may be embodied otherwise without departing from such principles.

I claim:

1. A bracing unit for securing formwork sections to a falsework structure supporting the formwork or to a previously poured section of a concrete structure, comprising a pressurized fluid inflatable and expandable hose positionable against the outside surface of the formwork section and a rigid abutment member supporting said hose and for securing said hose against the outside surface of the formwork structure whereby said hose and rigid abutment member are placed against the formwork sections with said hose in the deflated condition and then said hose is inflated and expanded for applying a uniform contact pressure against the formwork sections and pressing the formwork sections against the falsework structure or the previously poured section.

2. A bracing unit, as set forth in claim 1, wherein said abutment member comprises an elongated shaped rail, said rail being open along one longitudinally extending side with the open side facing toward the outside surface of the formwork section, and said shaped rail being resistant to bending.

3. A bracing unit, as set forth in claim 2, wherein said shaped rail has a U-shaped cross-section.

4. A bracing unit, as set forth in claims 1, 2 or 3, wherein the bracing unit is used for forming arcuately shaped concrete structures, such as circular structures, wherein said rigid abutment member is a circumferentially closed member in contact with the outside surface of the formwork sections.

5. A bracing unit, as set forth in claim 4, including means for dependently suspending said rigid abutment member from the surface of the formwork sections.

6. A bracing unit, as set forth in claim 5, wherein said shaped rail in the circumferential direction is formed of a plurality of rail sections, and flanges formed on the ends of said rail sections for interconnecting said sections.

* * * * *